US010209028B2

(12) United States Patent
Bofill

(10) Patent No.: US 10,209,028 B2
(45) Date of Patent: Feb. 19, 2019

(54) CROSSBOW

(71) Applicant: Peter Bofill, Hialeah, FL (US)

(72) Inventor: Peter Bofill, Hialeah, FL (US)

( * ) Notice: Subject to any disclaimer, the term of this patent is extended or adjusted under 35 U.S.C. 154(b) by 0 days.

(21) Appl. No.: 14/924,508

(22) Filed: Oct. 27, 2015

(65) Prior Publication Data

US 2017/0115090 A1 Apr. 27, 2017

(51) Int. Cl.
*F41B 5/12* (2006.01)

(52) U.S. Cl.
CPC ..... *F41B 5/123* (2013.01)

(58) Field of Classification Search
CPC ..... F41B 5/123; F41B 5/12; F41B 5/1469; F41B 5/1426; F41B 5/1407; F41B 5/1411; F41A 19/06
See application file for complete search history.

(56) References Cited

U.S. PATENT DOCUMENTS 4,388,914 A * 6/1983 Cesin ..... F41B 5/12 124/25
4,719,897 A * 1/1988 Gaudreau ..... F41B 5/1469 124/25
5,263,465 A * 11/1993 Anderson ..... F41B 5/1469 124/24.1
6,705,304 B1 * 3/2004 Pauluhn ..... F41B 5/12 124/25
8,485,170 B1 * 7/2013 Prior ..... F41B 5/123 124/25
8,701,642 B2 * 4/2014 Biafore, Jr. ..... F41B 5/123 124/25
8,863,732 B1 * 10/2014 Prior ..... F41B 5/123 124/25
8,991,375 B2 * 3/2015 McPherson ..... F41B 5/123 124/24.1
9,010,308 B1 * 4/2015 Hyde ..... F41B 5/12 124/25
9,038,619 B1 * 5/2015 Kempf ..... F41B 5/1426 124/89
2010/0170488 A1 * 7/2010 Rasor ..... F41A 11/02 124/25
2011/0308508 A1 * 12/2011 Islas ..... F41B 5/105 124/25
2012/0006311 A1 * 1/2012 Bednar ..... F41B 5/12 124/25
2013/0174825 A1 * 7/2013 Bednar ..... F41B 5/1407 124/88
2014/0261360 A1 * 9/2014 Pulkrabek ..... F41B 5/1469 124/35.2
2016/0273868 A1 * 9/2016 Carroll, Jr. ..... F41B 5/12

* cited by examiner

*Primary Examiner* — Melba Bumgarner
*Assistant Examiner* — Amir A Klayman
(74) *Attorney, Agent, or Firm* — Christopher J. Vandam, PA; Chris Van Dam

(57) ABSTRACT

A crossbow having a string below the barrel and an arrow rest on top of the barrel. The carriage rides in a track along the length of the barrel. A bottom side of the carriage contacts the string. The upper side of the carriage extends through the upper edge of the barrel and contacts the nock at the aft end of the arrow. The string does not contact the barrel. The string, at about a midpoint, contacts the lower side of the carriage. The string does not rub on the barrel of the crossbow so energy loss and friction damage to the string are avoided.

8 Claims, 21 Drawing Sheets

CROSSBOW

BACKGROUND OF THE INVENTION

Crossbows have encountered many significant technological advancements over the years. However, a some significant limitations remain, one being that is there is always a degree of variance in error when the firing string releases an arrow due to the varying nocking point along the string and the imperfect aligning of the string to the barrel using the current traditional configuration, two being that it is documented and noted that most crossbows are restricted to a certain heavier weight bolt in order to avoid dryfiring, a third limitation that is well documented is the traditional crossbow's need of rail lubricant after every 5-10 shots in order to protect the string from shredding on the rail, another limitation being that when firing a traditional crossbow, the kinetic energy that is pushed forward creates a shock wave throughout the bow that results in less consistent shots and sending stress throughout the vital components of the crossbow.

The present invention provides for a novel crossbow configuration whereby the arrow rides on a separate horizontal plane from the string, pushed along by the string powered carriage system that rides on a separate track, whereby the arrow never touches the release string. In using this arrow carriage system, the present invention will allow for a more consistent shot as the arrow will be consistently nocked at the same point onto the carriage system; the carriage will stay aligned with the barrel using it's separate but parallel track. The present invention's carriage system will house the string on it's own track, protecting the string from unnecessary wear and tear and eliminating the need for lubricants while still harnessing it's full power and maintaining the string centered, using this configuration, the present invention is able to use a low friction material for the arrow to ride on via a glued on strip or a fitted strip, without having to worry about the string causing unnecessary friction and damaging this material. A variety of configurations of weight added to the carriages will allow for a lighter or heavier bolt to be used without jeopardizing dryfire and creating the option to adjust the fps of the crossbow. The present invention uses a magnetic invisible shock system, in one embodiment, the present invention's carriage has magnets incorporated throughout; in conjunction with the built-in opposite polarity magnets at the end of the track, the carriage will have an invisible shock dampener that will slow down the carriage and decrease the stress of the impact onto the crossbow's vital components and therefore causing less shock to the shooter's hands resulting a more controlled shot. All together, coupled with a series of adjustable features and multiple shock reducers, the present invention will result in a smoother, more consistent, and accurate shot while protecting the vital components of the crossbow from impact stress.

SUMMARY OF THE INVENTION

In one embodiment, the present invention is a novel crossbow system comprising;

a firing mechanism;

a firing string;

a carriage configured to be operatively associated with each of said firing mechanism and said firing string, said carriage is configured to interchange a variety of different bolts at a variety of weights;

a crossbow arrow rail configured to hold a crossbow arrow in a first position before firing; said system configured such that a crossbow arrow in said first positioned is fired from said crossbow in a configuration providing no direct contact between said crossbow arrow and said firing string, whereby said firing string travels in a different geometric plane then said crossbow arrow.

In one embodiment, the carriage is configured to secure said firing string in a consistent knocking point position within a variance of +/−1%.

In one embodiment, the invention is including a two-track system configured to house the string carriage and allow limb pockets to be moved to a different geometric plane while still drawing power from the firing string to shoot an arrow.

In one embodiment, the carriage is configured with a hybrid nocking system is constructed and arranged to selectively accommodate either a full-capture nock of a standard arrow, or a full moon nock of a standard crossbow bolt.

In one embodiment, there is an Evo Hybrid Nock is constructed and arranged with a full capture nock clip and a full moon nock to use said carriage hybrid nock to keep an arrow positioned thereon from sliding forward, or away from a user, with said full capture nock as well as drawing the full power from the nocking system with said full moon nock.

In one embodiment, the invention is further comprising a dampening system that includes rubber bumpers for the string carriage, a magnetic brake system for the string carriage, at least one string stopper, at least one power limb damper, at least one rubber shock reducing grip, at least one rubber lined barrel extender, and an Evo butt stock shock dampening system that imparts reduced recoil as compared to conventional crossbows.

In one embodiment, the invention is 1 further comprising power limb dampers on limbs of said crossbow constructed and arranged to damper the limbs from vibration.

In one embodiment, the invention further comprises a configuration constructed and arranged for imparting a reduced recoil force by 5-10% compared to a conventional crossbow.

In one embodiment, the invention further comprises a configuration constructed and arranged for imparting a reduced sound produced by 5-15% compared to a conventional crossbow.

In one embodiment, the lowered limb pockets are configured in order to create a two-track system. The system helps accommodate the carriage track and flight track to separate the plane in which the arrow travels and the plane in which the string is riding on. That is to say, the arrow or bolt being fired and the firing string move in distinct, substantially parallel geometric planes.

In one embodiment, there is an interchangeable non-friction track to accommodate the different sizes of arrows.

It is contemplated in the present invention that a combination of adjustable features such as, extenders, adjustable stock, adjustable cams, carriage weight, arrow weights, power dampers working in conjunction to adjust the length, power stroke, and FPS of the crossbow.

The Carriage prevents the string from touching the rail and coupled with the Evo Superglide Strip the need for messy rail lube is eliminated.

The Carriage keeps the string in line with a consistent nocking point, eliminating the variance that would affect the flight of the arrow.

The Crossbow is made with a two-track system to house the string carriage and allow the limb pockets to be moved to a different horizontal plane while still drawing power from the string to shoot the arrow.

The Carriage's hybrid nocking system is engineered to take a full-capture nock of a standard arrow, while also being able to take a full moon nock of a standard crossbow bolt. The Evo Hybrid Nock is engineered with a full capture nock clip and a full moon nock to use the Carriage's hybrid nocking system in full effectiveness by keeping an arrow from sliding forward with it's full capture nock as well as drawing the full power from the nocking system with it's full moon nock.

By adjusting the weight of the Carriage, the shooter is allowed to fire a variety of lighter or heavier arrows, allowing the adjustment of fps and flight pattern.

The Crossbow's shock dampening system couples together a variety of features such as (Rubber bumpers for the string carriage, invisible magnetic brake system for the string carriage, string stoppers, power limb dampers, rubber shock reducing grips, rubber lined barrel extenders, and the Evo butt stock shock dampening system) in order to greatly reduce the recoil and damage that a crossbow's shot would induce on itself.

The power limb dampers are added to the limbs of the crossbow in order to damper the limbs from vibration incorporated with a power strip to also give extra power to the limbs by flexing before the shot and uses potential energy of the power strip to shoot the limbs forward without putting more strain on the bow. This promotes a quieter shot, as well as a more durable bow.

The Crossbow is built with customizable length and power adjustments that can be changed on a moments notice without a third party modification to tailor fit the bow to the shooter; these adjustments include the arrow configurations that are allowed due to the carriage (lighter/heavier and/or skinnier/fatter arrows), the amount of barrel extenders combined with the adjustments of the cams to compensate the power stroke due to the adjusted length, and the adjustable butt stock to adjust overall length.

Evo Foregrip can be kept in a tactical position or a flush-to-stock foregrip position and includes a removable and customizable thumb guard. The Evo Foregrip also has a magnetic pivot rest incorporated therewith.

The magnetic pivot rest uses it's shape and incorporated magnet to create a stable, pivoting bipod-like feel from a flat surface or a shooting stick ball.

Shooting stick ball can be screwed into a shooting stick, glued onto a surface, or suction cupped onto a surface to use the magnetic pivot rest socket. Coupled with the shooting stick ball, the bipod-like stability can be rotated a complete 360 degrees without hindrance as well as up and down.

The loading mechanism is a unique self-loading system that is mounted on the bow, allowing cocking the bow using minimal effort from any shooter including a handicapped person.

The Trigger guard is a sliding protector covering the trigger finger slot, prohibiting the accidental mis-fire caused by a non-attentive shooter.

Picatinny rail z mount is placed accordingly to allow the use of more attachments while still using the Picatinny quiver mount.

The system includes interchangeable rails to accommodate each of:

Lightweight Arrows (350-400 grains) Using a lightweight arrow increases overall speed and creates a flatter downrange trajectory. However, it transfers excess energy to the bow assembly and limbs, and generates increased vibration, stress, and noise. Depending on the crossbow, this excess energy may create a dry-fire effect, which can affect the durability of bow components.

Standard-Weight Arrows (400-435 grains) Standard-weight arrows are the arrow of choice for most manufacturers because they "quiet" noise and vibration levels in virtually all modern crossbows.

Heavyweight Arrows (435 grains or higher) A heavyweight arrow, up to 750 grains, produces and retains the largest amount of kinetic energy, A heavyweight arrow will also produce the quietest and most vibration free shot of all other weight choices.

Just as with any other regular hunting bow or firearm, your crossbow needs to have the appropriate items to make it work at maximum performance. That includes your arrows. Selecting the right one that will fly the best, hit the hardest and do the job is critical.

With a wide array of crossbow arrows available to consumers in the market today, selecting the right arrow for your shooting or hunting situation can seem like a difficult task—speed, kinetic energy, trajectory, and overall performance vary amongst different weighted arrow.

Most crossbow manufacturers specifically recommend a minimum grain weight bolt for use in their various crossbow models. Shooting underweight arrows (bolts) puts your bow's components under considerable stress. In addition, shooting underweight arrows may void your factory warranty and put you at risk of personal injury—should a limb, string, or other bow component fail.

Some people refer to the crossbow projectile as a bolt, while others call it an arrow. Both definitions are correct, however the word "bolt" can only be used in conjunction with a crossbow (never with a regular bow). Technically speaking, a bolt has no stabilizing vanes near the back, while an arrow always does. Linguistically speaking, however, whenever someone talks about crossbow bolts or arrows, they are usually speaking of the same thing.

two-track system; said system helps accommodate the carriage track and flight track to separate the plane in which the arrow travels and the plane in which the string is riding on.

Interchangeable non-friction track to accommodate the different sizes of arrows

In one embodiment, both tracks are interchangeable and are both non-friction.

Most crossbow shooters try to shoot a lighter arrow to achieve more feet per second (fps) the problem with lighter arrows is that it puts a lot of strain on the bow and makes the bow very noisy, typically you should not go and shoot less than 350 grams of weight of an arrow, it's almost like dry firing the crossbow and that puts a lot of wear and tear on all the components of the bow, that can ultimately cause the bow to break down, and cause injury to you, So by Implementing the EVO Carriage system, and changing the weight on the EVO Carriage system it self to Achieve Proper weight in order not to cause damage to the bow, this will also eliminate noise and Vibration of the crossbow, now the shooter can just pick the arrow of their Desire without worrying of Vibration, Noise and most of all Damage to the Crossbow

DETAILED DESCRIPTION OF THE PREFERRED EMBODIMENTS

Figure 16:
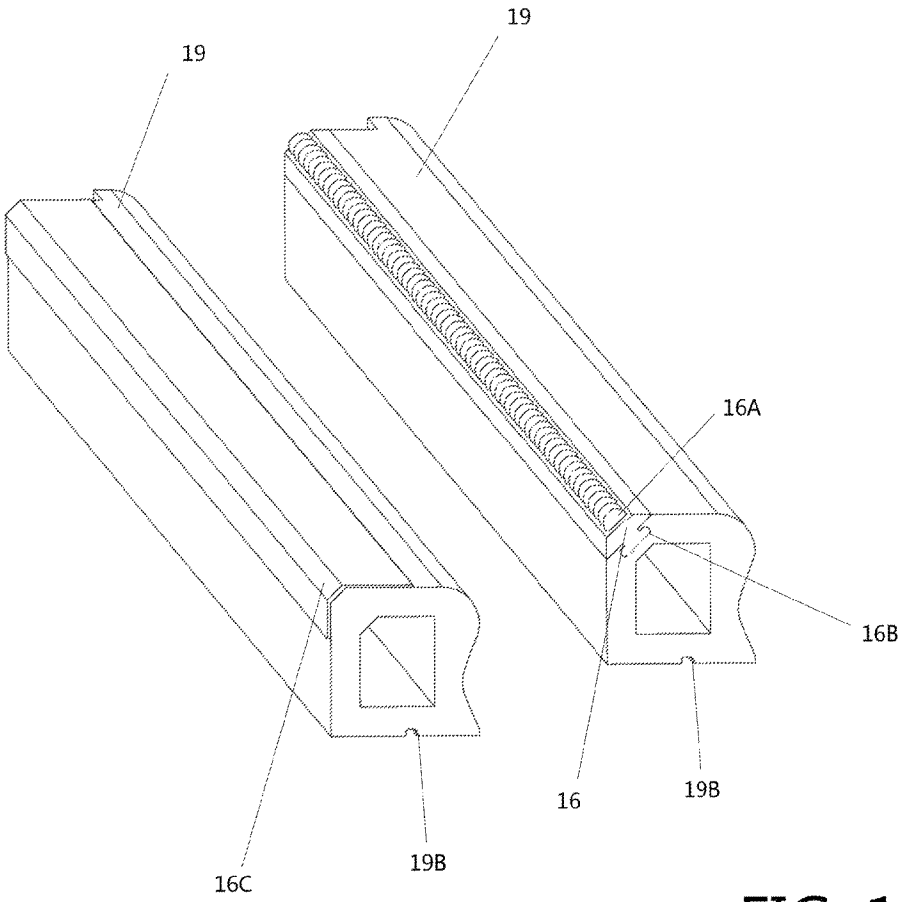
FIG. 16 is a front quartering view of two variations of the Self Lubricating Teflon Flight Track Strip, in one embodiment, the track strip has Raised Protuberances throughout the strip and is slid into the barrel using a track on the barrel as shown on the right, in the alternative embodiment on the left, the track strip is placed on the barrel of a traditional crossbow's barrel using a self-adhesive without alteration to the barrel.
Figure 17:
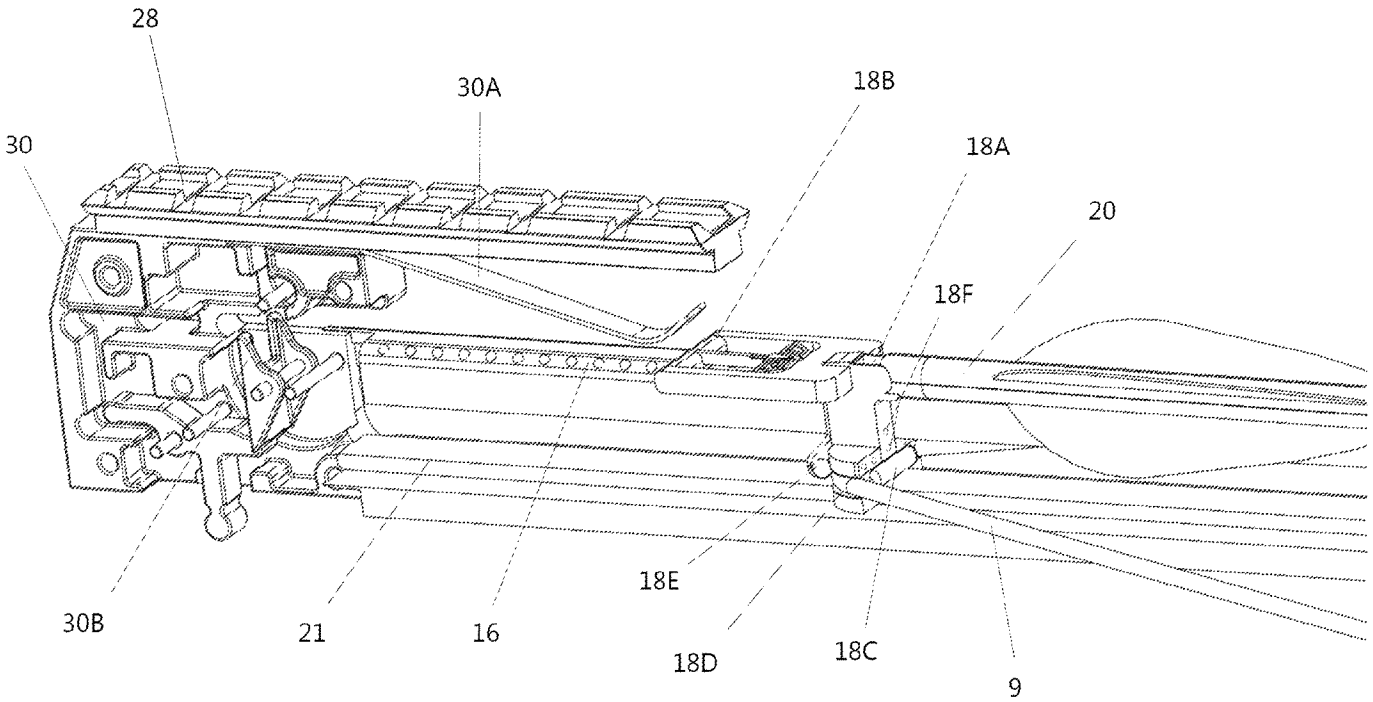
FIG. 17 is a side perspective view in the moments after the carriage is released for a shot with the trigger mechanism open.
Figure 18:
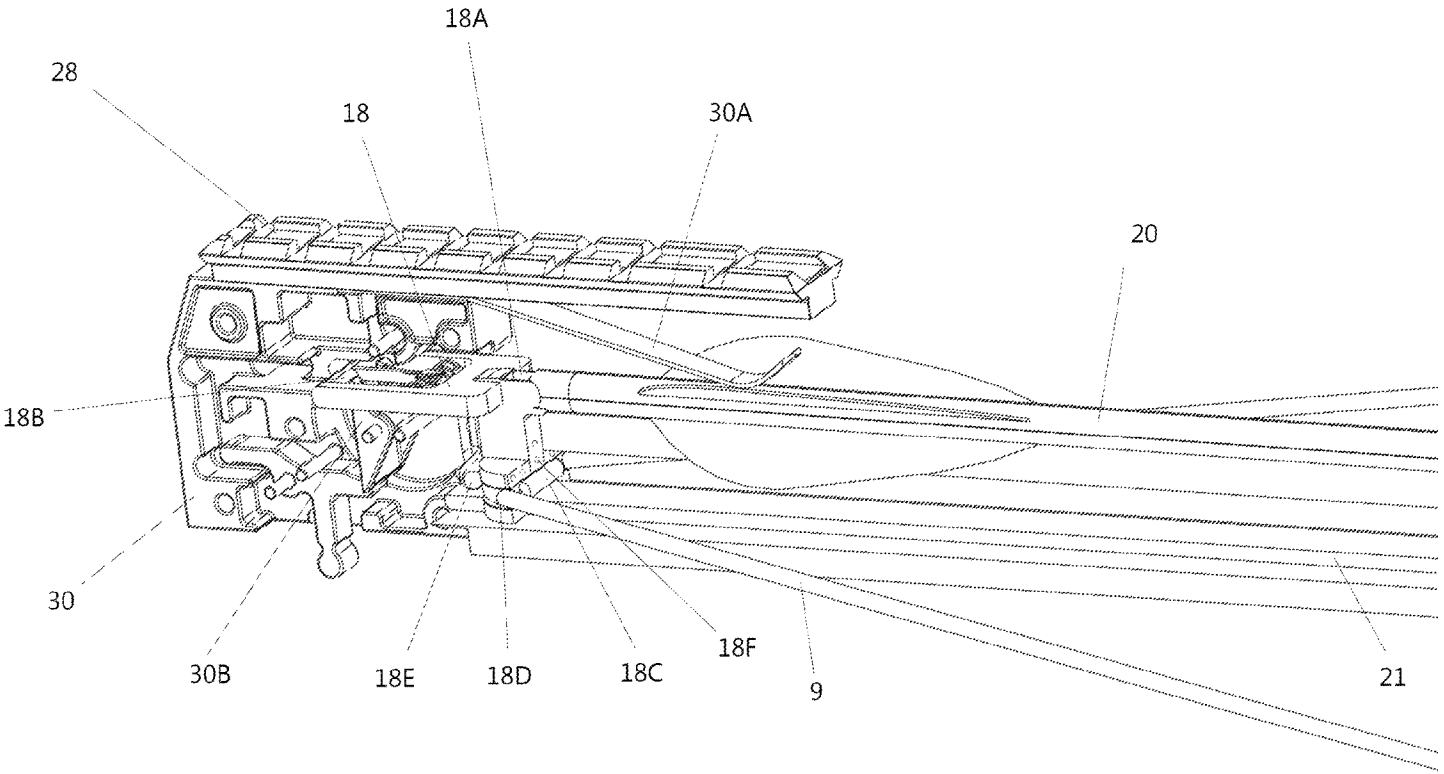
FIG. 18 is a side perspective view of the present invention ready to fire with the carriage locked into the trigger mechanism.
Figure 19:
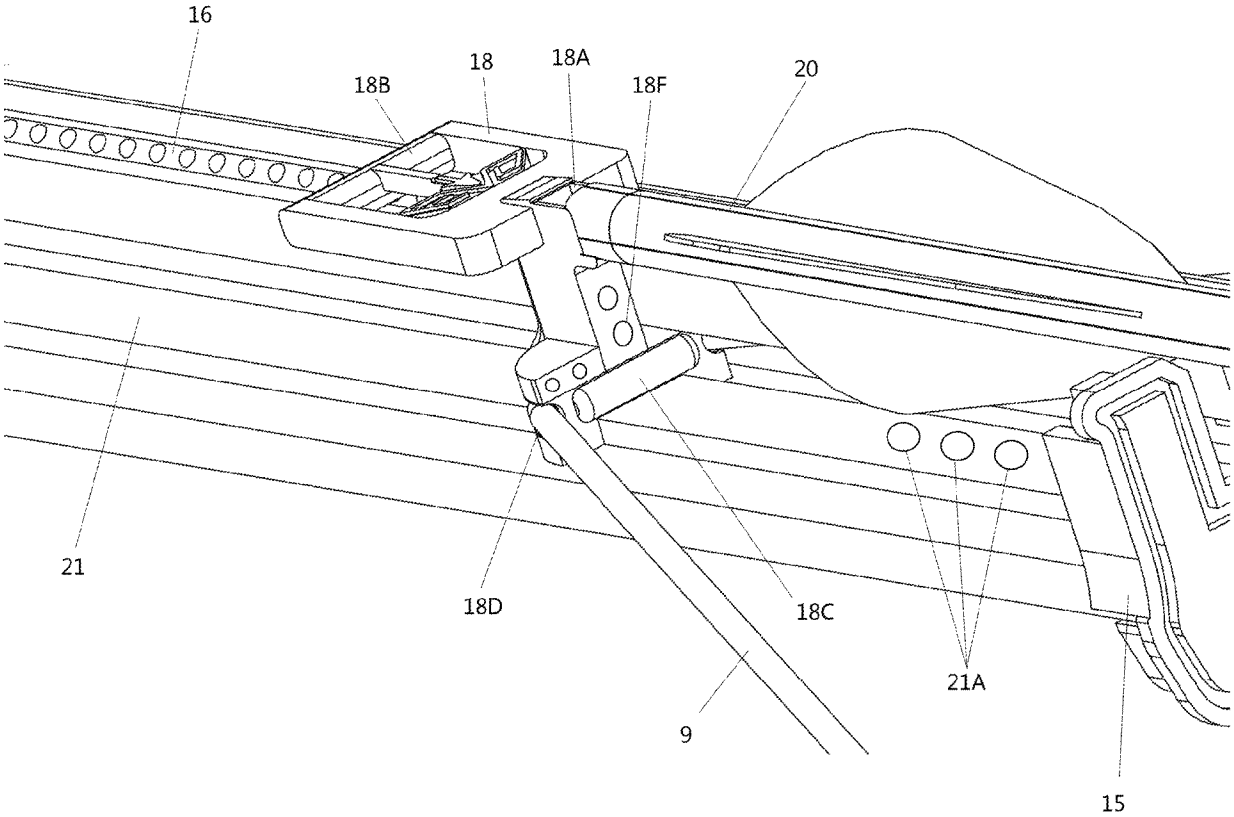
FIG. 19 is a side perspective view of the Carriage during the crossbow's power stroke when firing. The magnets on the carriage are opposite polarities from the magnets on the carriage track, subsequently pushing the carriage back and slowing down the string before impact.
Figure 20:
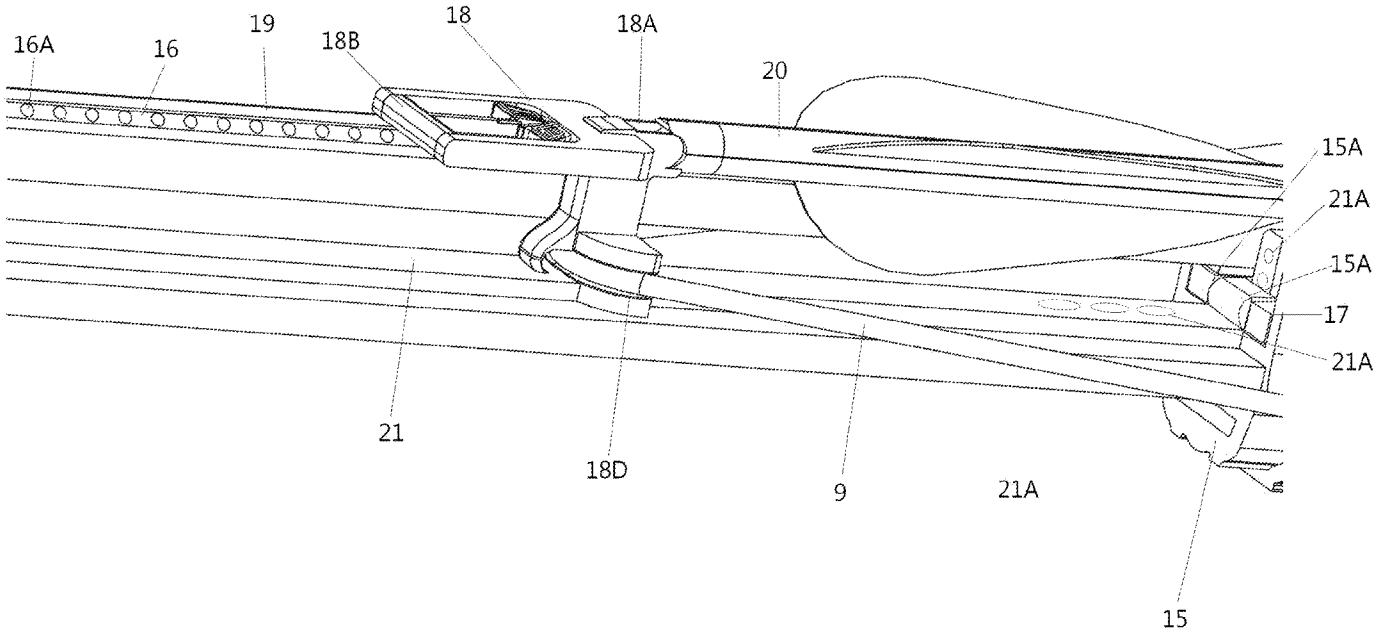
FIG. 20 is a side perspective view of the Carriage during the crossbow's power stroke when firing. The magnets on the carriage are opposite polarities from the magnets on the carriage track and end cap, subsequently pushing the carriage back and slowing down the string before impact with the rubber bumper.
Figure 21:
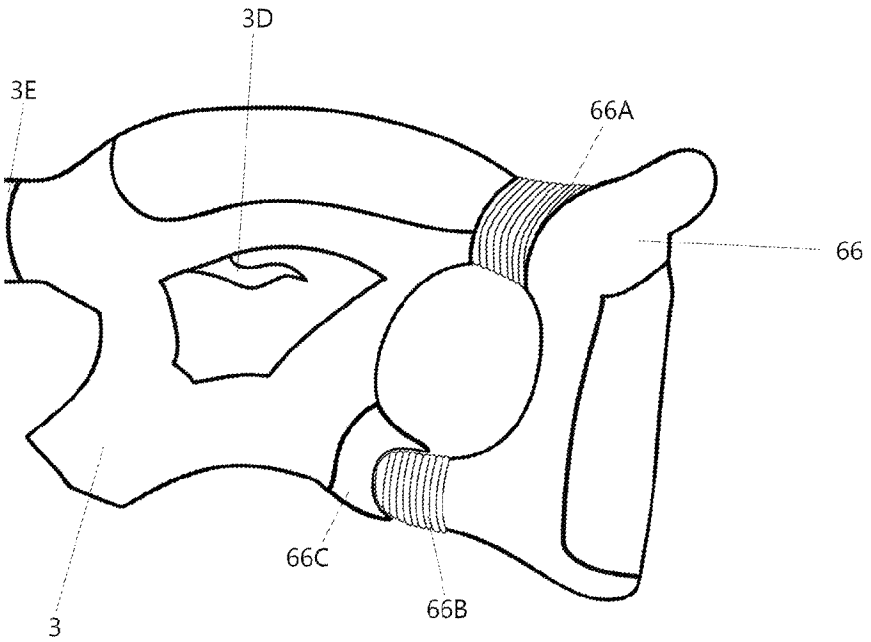
FIG. 21 is a side view of the stock's shock dampening system.

The present invention relates to a novel crossbow assembly 100 that incorporates a two-track system with front riser 8 lowered to a separate track with the string 9 and keeping the arrow on it's own flight track 19/19A. The system includes a Carriage track 21 where the Carriage 18 rides under right flight track 19 and a left flight track 19A. The system is configured to receive an arrow 20 at arrow nock 20A as is commonly used with crossbows. Crossbow assembly 100 is configured to shoot arrow 20 without string 9 directly touching arrow 20 and without the arrow 20 having to be on the same horizontal plane as the Front Riser 8. Crossbow assembly 100 allows the use of a flight track, in one embodiment of the present invention, composing of a flight track, but not limited to a separated right flight track 19 or left flight track 19A to be exclusively for the arrow, eliminating the common need of applying rail lube on the track to prevent wear and tear of the string that is traditionally kept on the same horizontal plane as the arrow. The system is further configured with a flight track strip 16 made of a low friction material, including a plurality of raised protuberances dependent on flight track strip 16 and emanating upward from the upper surface of flight track strip 16. In one embodiment, flight track 16 is a self-lubricating Teflon flight track strip that is either slid into place using Teflon Flight Track Sliding Track 16B as shown in FIG. 16 and alternatively on the flight track 19 and 19*a* or placed using Teflon Flight Track Self-Adhesive Strip 16C a self adhesive onto the flight track on the present invention or on a barrel of a traditional crossbow, in one embodiment, being made to fit on the standard crossbow barrel as well as made in a variety of sizes to compensate for the bolt size. String carriage 18 is associated with string carriage track 21 and string loading mechanism 22.

Figure 1:
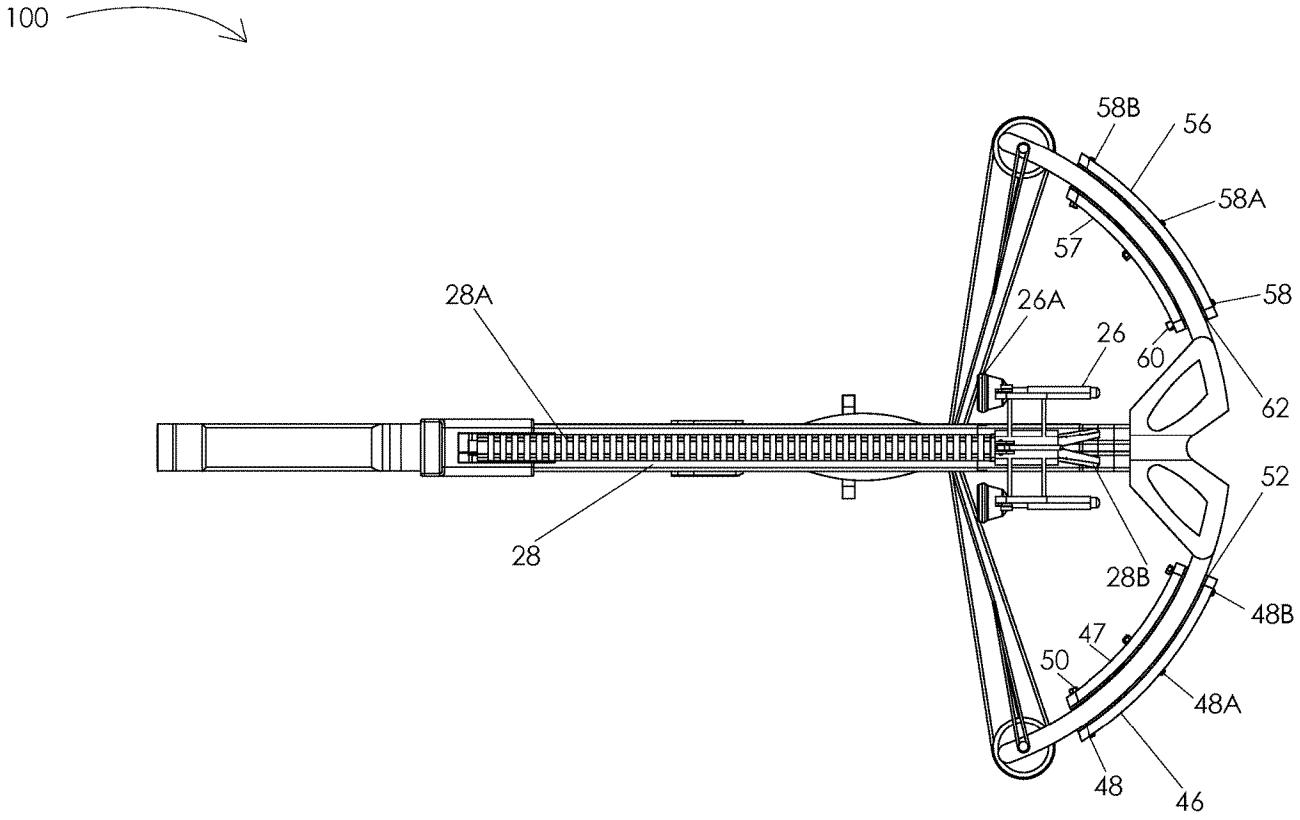
FIG. 1 is a top view of one embodiment of the crossbow according to the present invention.
Figure 2:
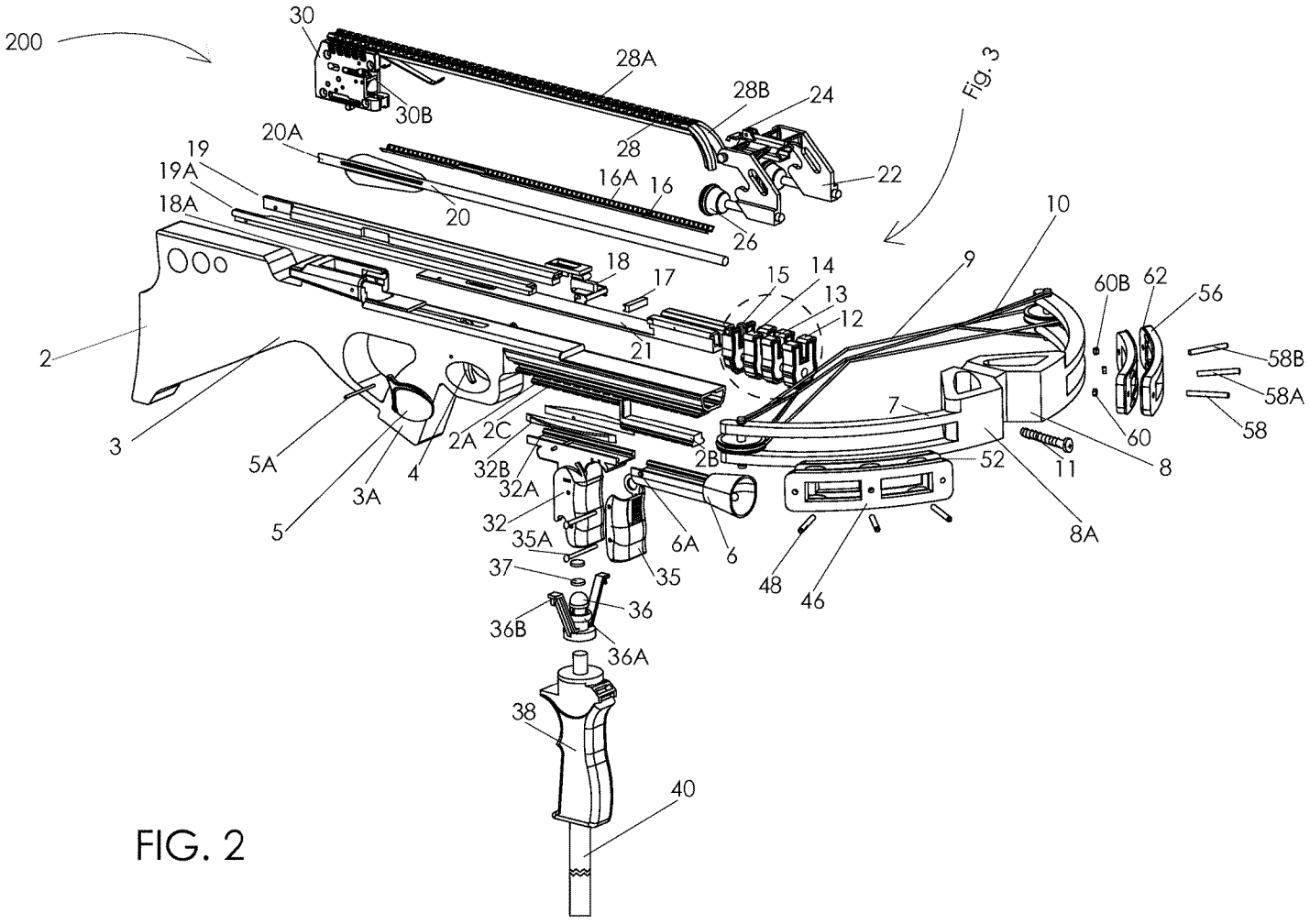
FIG. 2 is a side perspective view demonstrative of separated components of the crossbow according to one embodiment of the present invention.

FIG. 2 is a side perspective view demonstrative of separated components 200.

The Carriage track 21 is under the flight track 19/19A.

The system further includes a crossbow body 2 that includes an adjustable butt-stock 3, a crossbow trigger 4, and crossbow trigger guard 5 incorporated therewith. In one embodiment, adjustable butt-stock 3 has a removable, wrap-around gel grip 3A incorporated therewith. In one embodiment, trigger guard 5 has a trigger guard roll pin 5A associated therewith.

As generally understood, Picatinny rail 2A is a mounting platform that Crossbow body 2 has incorporated therewith in order to allow the mounting of accessories and tools by either sliding from one end or snapping them into position and locking them between raised sections by utilizing the Picatinny mounting clamp 2C. As is known, the Picatinny rail Z mount 2B is a half-length flush with the original body rail to which it is clamped, whereby approximately half of Picatinny rail Z mount 2B is on a lower plane, desirably allowing for the crossbow quiver to be positioned on the furthest edge of the Crossbow body's built-in rail 2A and still leaving room for accessories to be parallel on the lowered section of the Picatinny Rail Z mount 2B in order for accessories such as flashlights to be functional without obstruction. In one embodiment, crossbow body 2 further includes a low profile flashlight attachment 6 that has bulb 6C incorporated therewith. Additionally, low profile flashlight attachment 6 is attached to Picatinny Rail Z mount 2B utilizing locking bar screw 6A.

Crossbow assembly 100 includes cable 10 operatively associated with crossbow string 9. Cable 10 is configured to be operatively associated with adjustable cams 10B that rotate about cable post 10A and are associated with cable slide 10C. String 9 encompasses the main firing mechanism of crossbow assembly 100 and is positioned as described herein.

Figure 3:
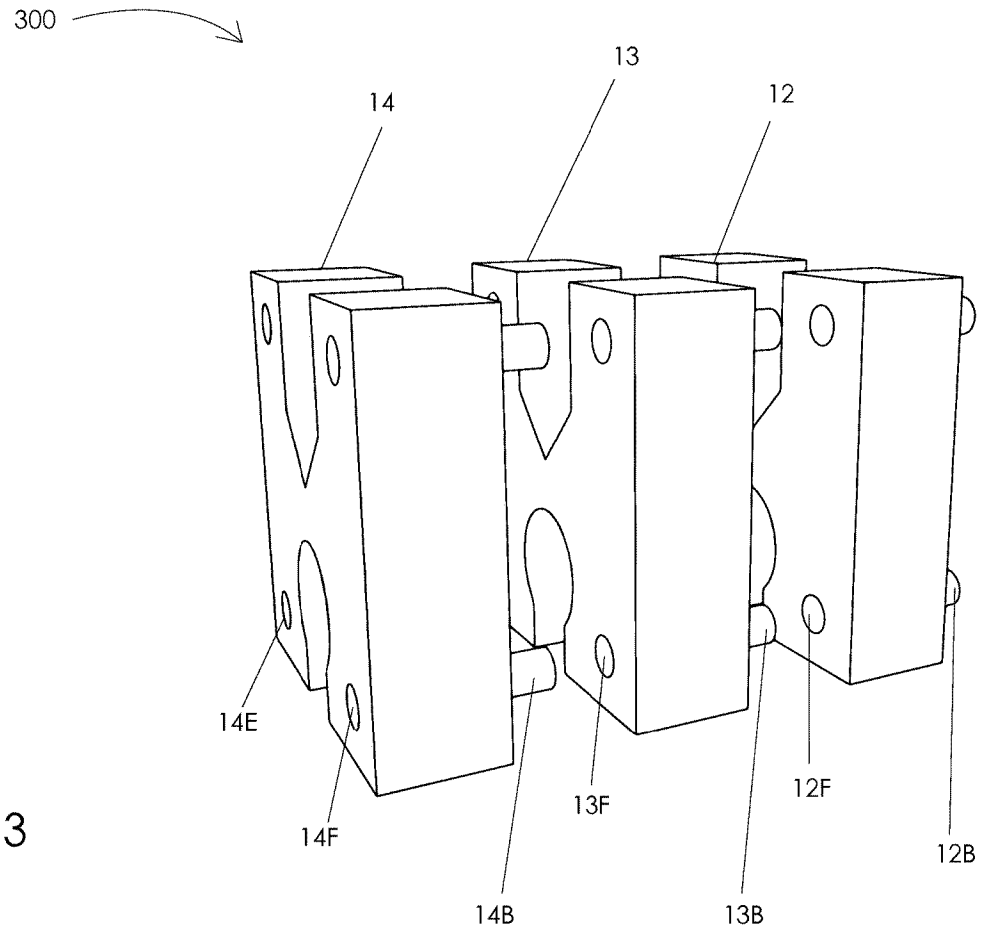
FIG. 3 is a side perspective view of an extender assembly utilized in the crossbow according to one embodiment of the present invention.

In one embodiment, extender assembly 300 includes at least two extenders. Although FIG. 3 demonstrates a configuration with three extenders, the present invention contemplates using anywhere between two and six extenders. A preferred embodiment includes the three extenders demonstrated in extender assembly 300 of FIG. 3. First extender 12, second extender 13, and third extender 14 are constructed and arranged, each with respective extender mounting pins and receiving orifices. As demonstrated in FIG. 3, first extender 12 has extender mounting pin 12B on one side and extender mounting pinhole 12F on the opposite side. Second extender 13 has extender mounting pin 13B and extender mounting pinhole 13F. Third extender 14 has extender mounting pin 14B and, as demonstrated in the figure, extending mounting pin holes 14E and 14F. As can be seen in the figure, one preferred embodiment includes each extender having four mounting pins and four receiving mounting orifices. The extenders are constructed and arranged to adjust the distance from the riser to the barrel and body as a whole, which in turn adjusts the power stroke imparted by the crossbow system of the present invention and overall length of the bow in order to adjust for varying shooters. This is particularly useful in a configuration that allows for adjustment of release velocity of arrow 20 when fired. Although the present invention provides for extender assembly 300, it is contemplated, in one embodiment, crossbow system of the present invention need not include any extenders at all. In an embodiment where extenders are used, an end cap 15 represents the proximal edge of extender assemblies attaching to carriage track 21. Extender screw 11 fastens the extender to end cap 15, track strip 16, right flight track 19 and left flight track 19A.

In one embodiment, adjustable butt-stock 3, moves in order to adjust the overall length.

Although adjusting the length of the crossbow has been done, It is contemplated that the combination of the varying amount of extenders in correlation with the adjustable cams, the power stroke may be adjusted to meet the desired power needed to fit the length of the barrel without having to give up the strength of the crossbow.

String carriage 18 will ride on carriage track 21 that is sitting on crossbow body 2, located underneath right flight track 19 and left flight track 19A. String carriage 18 will be pushed forward with unobstructed movement when firing. The upper portion of string carriage 18 will come through the middle of right flight track 19 and left flight track 19A and serve as the string carriage trigger latch catcher 18B when the bow is cocked, and will also serve as the Carriage's Arrow Nock 18A for a bolt to rest on. When fired, the system will launch the arrow on a flight track in a friction-free manner off the crossbow without the string ever directly touching arrow 20. It is known that a traditional crossbow should never be dry fired (fired without a bolt) and must use a bolt with a specific weight in order to transfer a certain amount of kinetic energy from the limbs into the bolt in order to avoid the stress caused by the pulled limbs to be shot back into itself and hurting the limbs; firing a bolt that is too light is like dry firing a bow and can cause premature failure of the crossbow. In one embodiment, the String Carriage 18 has been given an according weight in order to be able to use a variety of lighter bolts and arrows, which will result in higher velocity and a further distance while compensating for the lost weight of the arrow to prevent the stress. In one embodiment, the String Carriage's Arrow Nock point is configured to interchange different types of nocks; as traditional crossbow arrow nocks (ex. Moon Nock or Flat Nock) are designed to solely be pushed against the string and traditional bow arrow nocks (ex. Full Capture Nock) are usually made to fit streamline around the string, the string carriage's arrow nock has been engineered to have the initial shape of the moon nock on the sides with enough space to securely fit the traditional crossbow nock, the center of the Carriage's nock is machined to be in the shape of the string with a pinched curve in order to accommodate traditional full capture bow nocks to be snapped into place and immensely reducing the chance of the nock sliding forward before a shot, keeping the shot more consistent, as the Carriage will push the arrow in the exact same spot every time opposed to traditional crossbows where the string may hit the nock in different spots or may allow the bolt to slide forward and launch the bolt in a less consistent manner. The String Carriage's Nock is configured in order to give the shooter a personalized nock option to fit their shooting skills around their environment.

For example, Evo Hybrid Nock 65 is configured to completely utilize every curve of the String Carriages Nocking point, it's initial Moon Nock curve rests perfectly on 18*a* Nocking point and it is designed with a full capture Nock inside in order to securely clip onto the string-like inner nocking point. This Hybrid Nock will ensure an exact locked-in fit every time a bolt is loaded, eliminating the factor of the bolt sliding up the rail and giving a very consistent launching point. Traditional crossbow bolt full moon nocks have an inconsistent launching point due to the lack of a clip.

In another embodiment Full Moon Nock Curve 65*a* provides an Evo Hybrid Nock molded to the crossbow traditional full moon nock to press against the string carriages nocking point and to keep the bolt vertically secure.

IN another embodiment, Full Capture Nock Clip 65*b* is configured to allow the String Carriage's Nock to securely spread it's launching power across the whole nock while securely keeping the bolt locked in place and consistently pushing the arrow's nock. This Full Capture Nock Clip will keep the factor of a sliding bolt from affecting the crossbow's shot.

String carriage 18 will be stopped by carriage rubber bumper 17 that works as a cushion to help stop the carriage in a friction-free manner. String carriage 18 will save the string from wear and tear, since the string is always on the carriage and will not be rubbing on the flight track or locking directly into the trigger latch mechanisms. Carriage pushes the arrow in a more consistent manner because it is on a less resistant track, it is documented that traditional crossbows must be lubricated after 5 to 10 shots in order to maintain the string, the present invention eliminates the need to lubricate the flight track. String carriage 18 also gives firing string 9 a consistent anchor point when loading arrow 20 into the crossbow system of the present invention.

As previously discussed, right flight track 19 and left flight track 19A are located above string carriage 18 and carriage track 21. This is the guiding mechanism that provides for precise firing of arrow 20. There is a thin, open lane down the middle for the top of string carriage 18 to protrude through and serve as nocking point 18A while resting on the flight track to provide for consistent straight firing. The barrel has been engineered with a thin track Carriage Barrel Track Female 19B, where a small ridge Barrel Track Male 18G on the carriage will ride in to ensure an aligned shot every time.

The ergonomically engineered stock uses two recoil dampening rubber separators Rubber Shock Absorber 66A and Flex Rubber Shock Absorber 66B incorporated therewith between the back end of the stock that is pressed against the shooters shoulder and the front of the stock that is connected to the crossbow. Using an accordion-like rubber separator as well as using a solid rubber separator sustained in a Rubber Shock Cup 66C will create a superior recoil dampening system that will help shooters have a more consistent follow through on their shot as well as a raised level of comfort.

The Carriage track has been configured with a built-in magnetic shock system Carriage Track Magnets 21A incorporated therewith in the general direction of the speeding bolt in order to use the reverse polarities of magnets incorporated in the Carriage 18, Carriage Magnets 18F to slow down the carriage once the power stroke has completed propelling the arrow in the moments of firing the crossbow. This carriage magnetic shock system will reduce the noise of the bow, while also protecting the vital components on the crossbow from the stress created by the shot's kinetic energy from the limbs and string. In one embodiment, coupled with the rubber bumper, will result in a superb shock dampening system.

The Trigger Guard is a unique sliding protector attached by 5*a* Trigger Guard Roll Pin over side of the trigger slot on the body to be a preventer from the crossbow being accidentally fired adding additional safety to the crossbow when the guard is down in safe position. In one embodiment, the Trigger guard can be easily flipped up by thumb or index finger and ready to shoot when needed.

The Limb Damper is a power enhancer and a shock reducer that is attached on both sides of the limb. The inside (power side) of the Limb Damper adds to the potential energy of the pulled back limb, by flexing itself to fit the inner curve of the limb and creating added tension to a cocked crossbow that will help shoot the limbs forward when the trigger is pulled. When the crossbow is fired and the limbs shoot forward, the outside (shock reducing side) of the limb damper will catch the limb as it moves forward, cushioning the limbs and easing the kinetic energy that is stressing the limb from the shot. The limb damper will work to increase the power that the limb can induce, reduce vibrations from the kinetic energy, and reduce the chances of the limb to twist after a shot. The Limb Damper will be sandwiched to the limb by screws that will securely clamp down and bolt both dampers to the limb, in another embodiment, the Limb Dampening and power enhancing system can be used as two separate strips or consolidated to one strip and adhesively glued on to the limb. The Limb Damper will help for a stronger and more accurate flight, as well as also increasing the life of the limb. The Limb Damper can help adjust the fps without putting stress on the cam. 2 Dampers will be needed for each side of a split bow or one damper in the middle of a recurve.

String loading mechanism 22 is mounted on string loading mechanism track 28 that includes string loading mechanism crank 24, string stopper 26, and optionally rubber string stopper 26A. String loading mechanism 22 is moved back and forth using string loading mechanism crank 24. String loading mechanism crank 24 rides on track ribs 28A, attached to string loading mechanism 22 and string stoppers 26. String stoppers 26 are constructed and arranged to stop the string and absorb vibration from the string's kinetic energy, and string stoppers 26 will be used to push firing string 9 along with string carriage 18 until string carriage trigger lock 18B is locked into place with trigger mechanism 30. Once loaded, string-loading mechanism 22 will manually slide forward and lock into position at the front, along with string stoppers 26, in a ready position to be fired. Once locked into original position, the crossbow is ready to fire, and when shot, the string will urge arrow 20 forward and release energy onto string stopper 26, ultimately being cushioned by rubber string stopper 26A.

In one embodiment, string loading mechanism track 28 also serves as a scope mount. String loading mechanism track 28 is mounted on trigger mechanism 30 at a higher level than track ribs 28A. The proximal end of the Picatinny rail used to mount the scope extends from front riser 8, and using loading mechanism mount 28B, is secured onto front riser 8. String loading mechanism track 28 is also used as the Picatinny loading mechanism track. Trigger mechanism 30 includes an arrow retention spring 30A and a latch 30B. Latch 30B holds string carriage trigger lock 18B securely in a ready position to fire. Once crossbow trigger 4 is actuated, latch 30B is released and will release string carriage 18.

Figure 4:
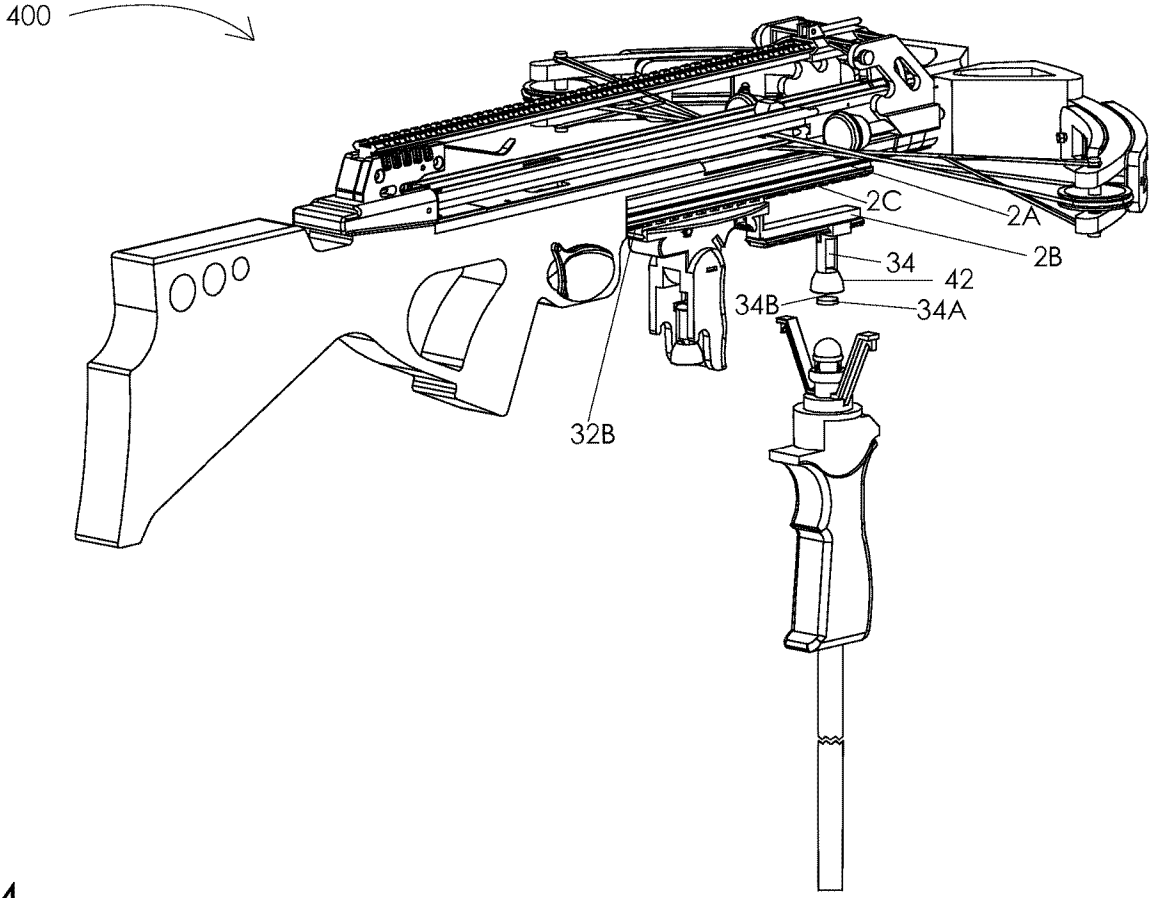
FIG. 4 is a side partially separated view of the crossbow assembly according to one embodiment of the present invention.
Figure 5:
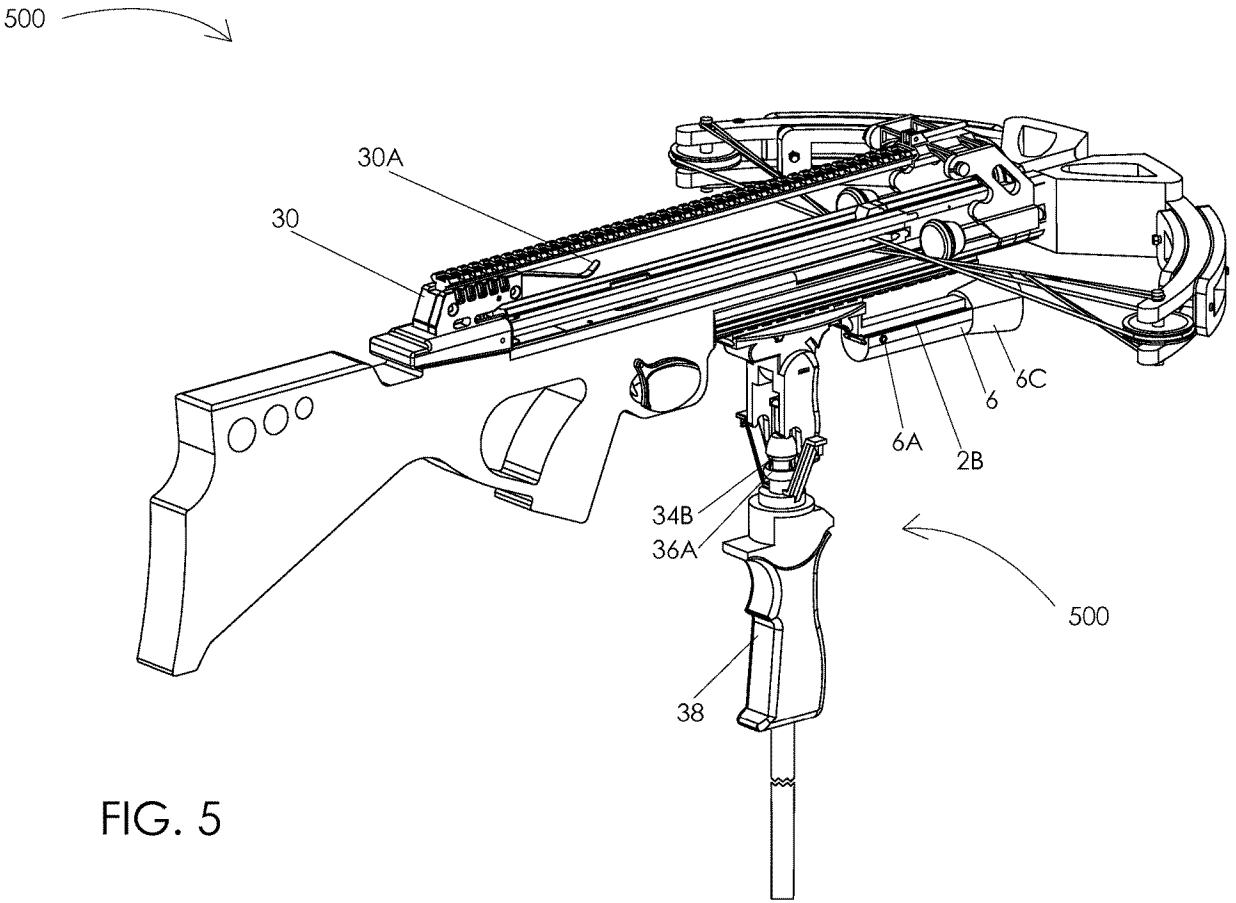
FIG. 5 is a side perspective view connected sequentially from FIG. 4.
Figure 6A:
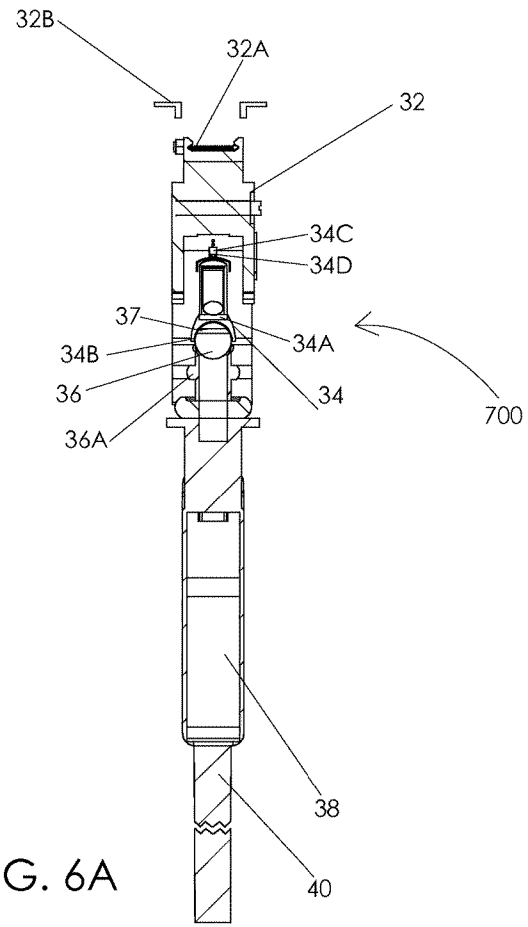
FIG. 6A is a front partial cross-section view from FIG. 6.
Figure 6:
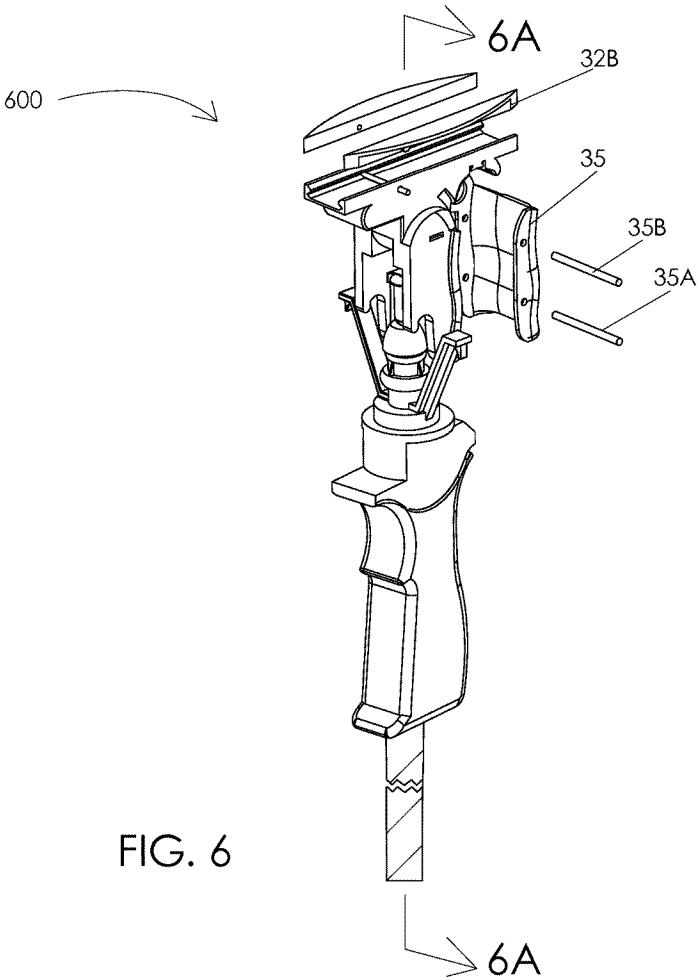
FIG. 6 is a side partial separated view of the shooting stick grip assembly according to one embodiment of the present invention.
Figure 7A:
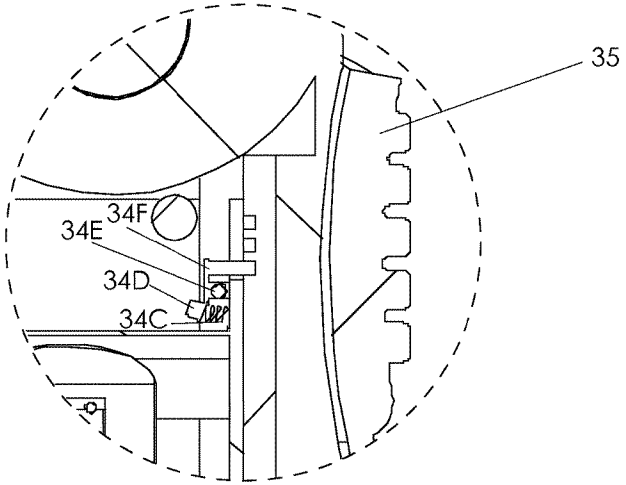
FIG. 7A is an expanded view from FIG. 7 of the removable grip portion according to one embodiment of the present invention.
Figure 7:
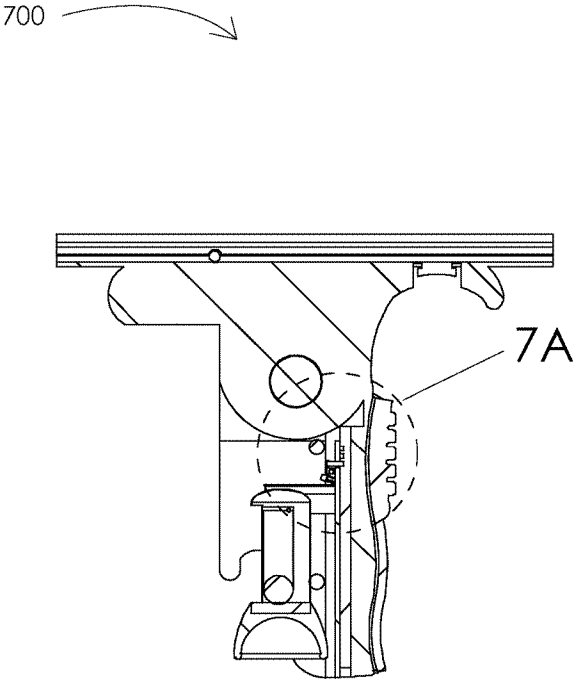
FIG. 7 is a partial side cross-section view of the shooting stick grip assembly according to one embodiment of the present invention.
Figures 8, 8A:
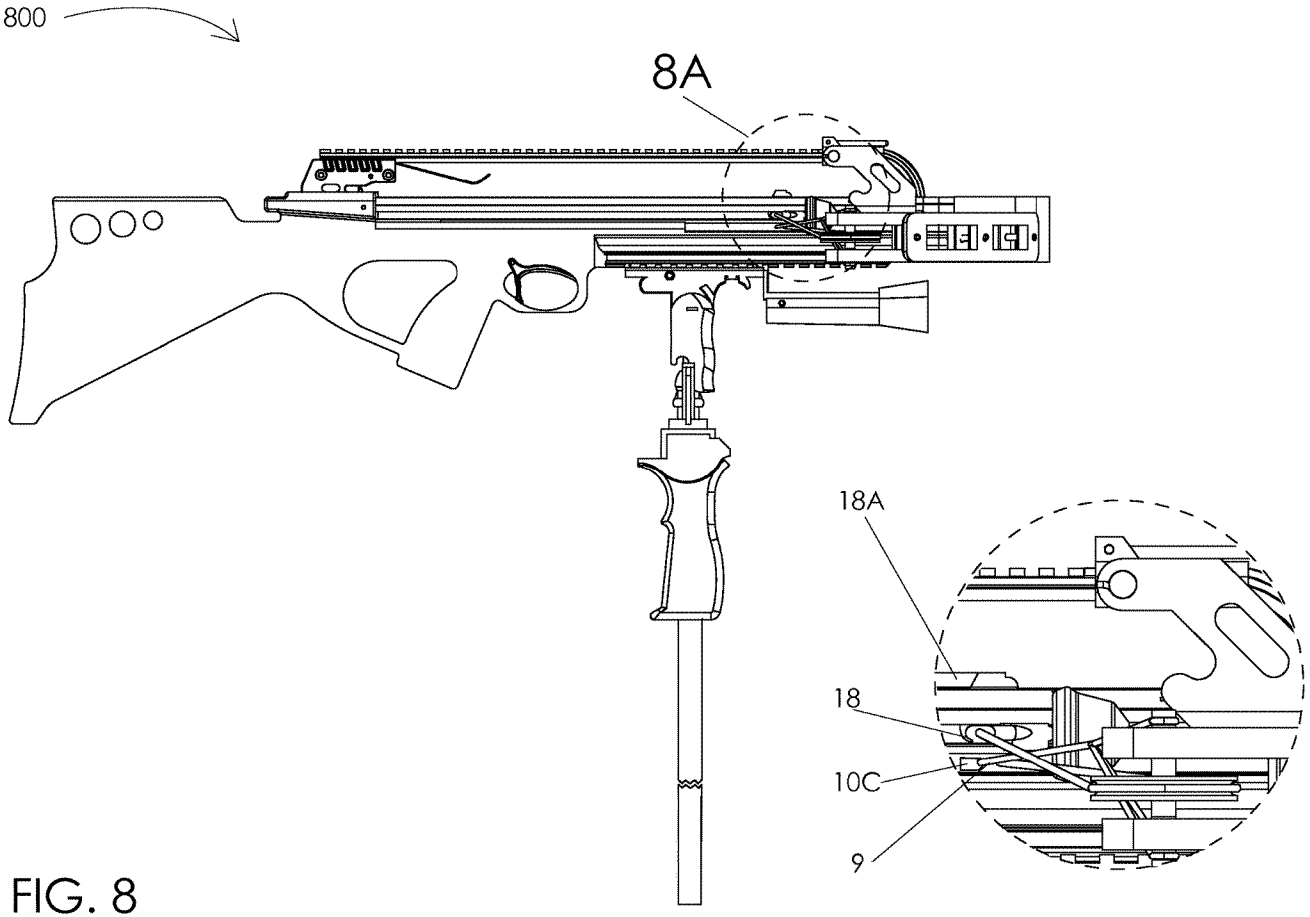
FIG. 8 is a side view of the crossbow assembly according to one embodiment of the present invention.
FIG. 8A is an expanded view from FIG. 8 of the riser and string carriage components according to one embodiment of the present invention.
Figure 9:
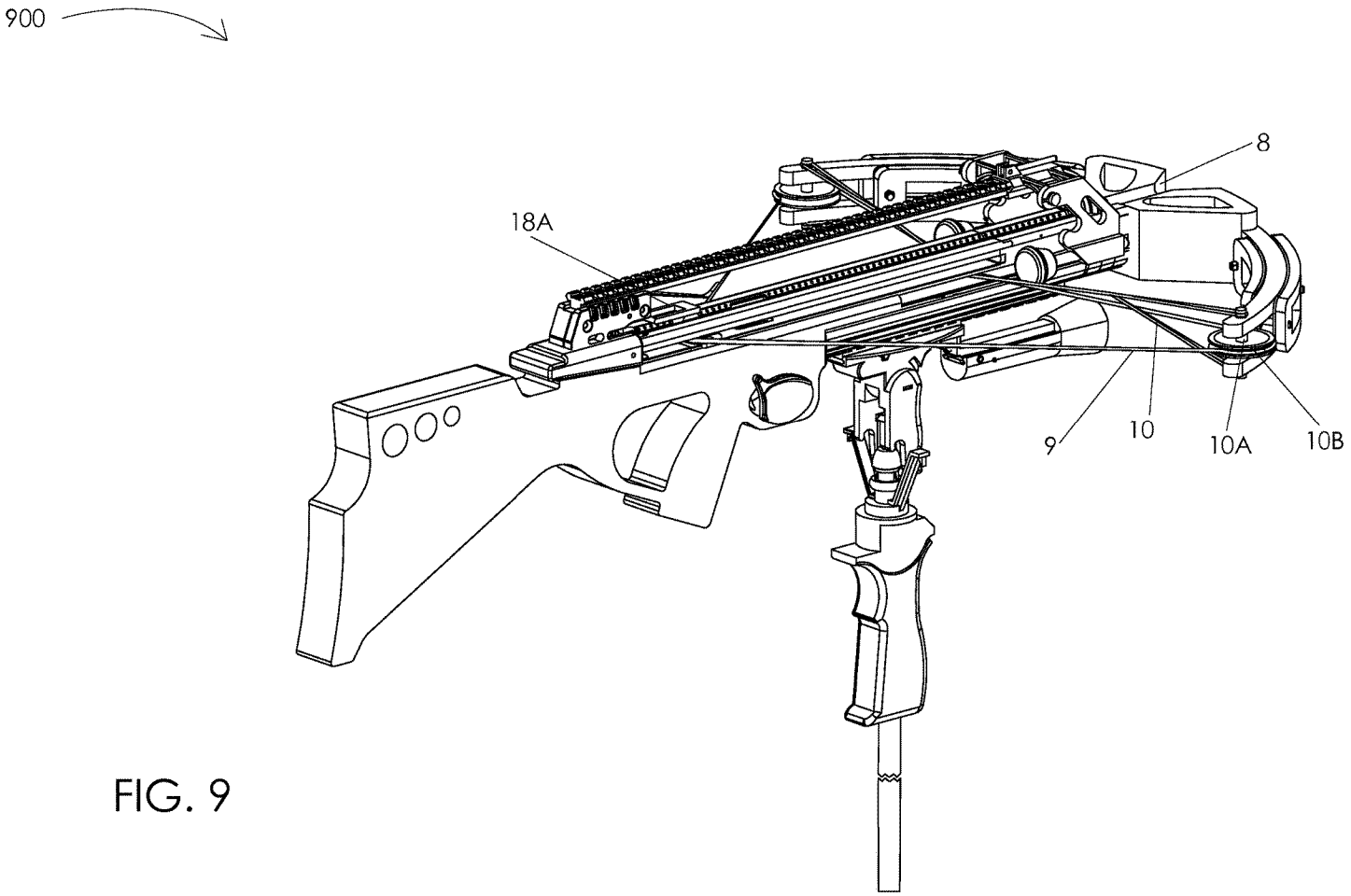
FIG. 9 is a side perspective view of the crossbow in a configuration ready to be fired according to one embodiment of the present invention.
Figure 10:
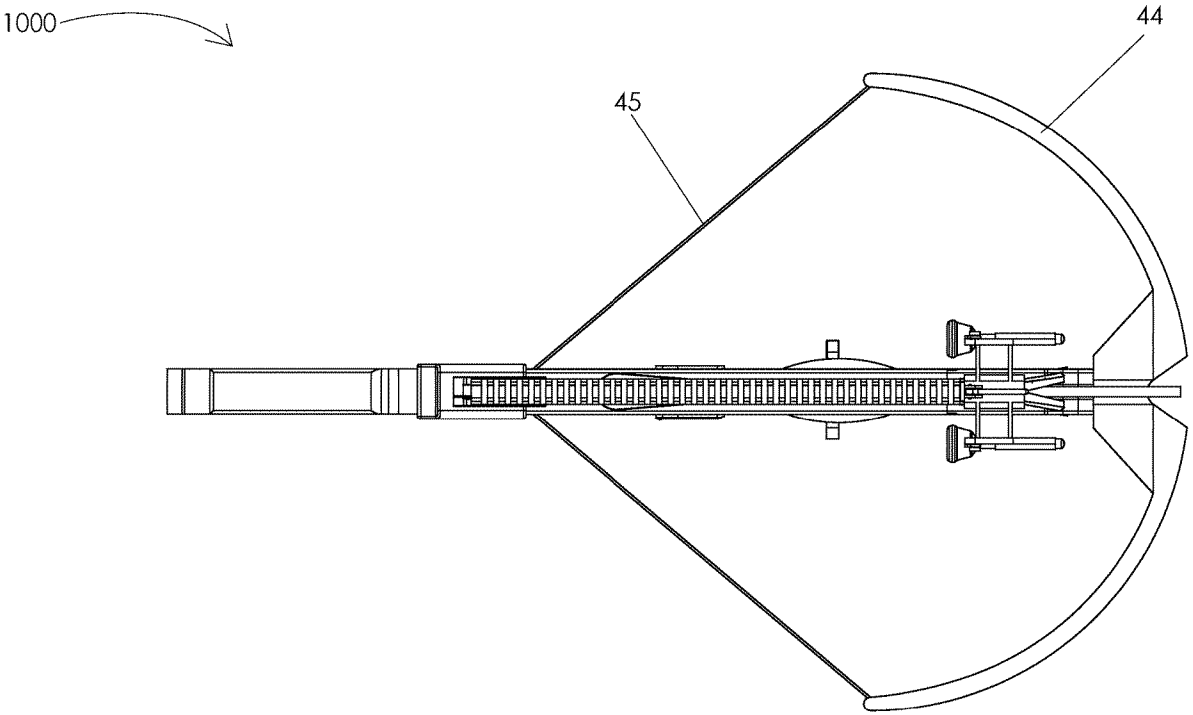
FIG. 10 is a top view of the crossbow of the present invention in a position ready to be fired.
Figure 11:
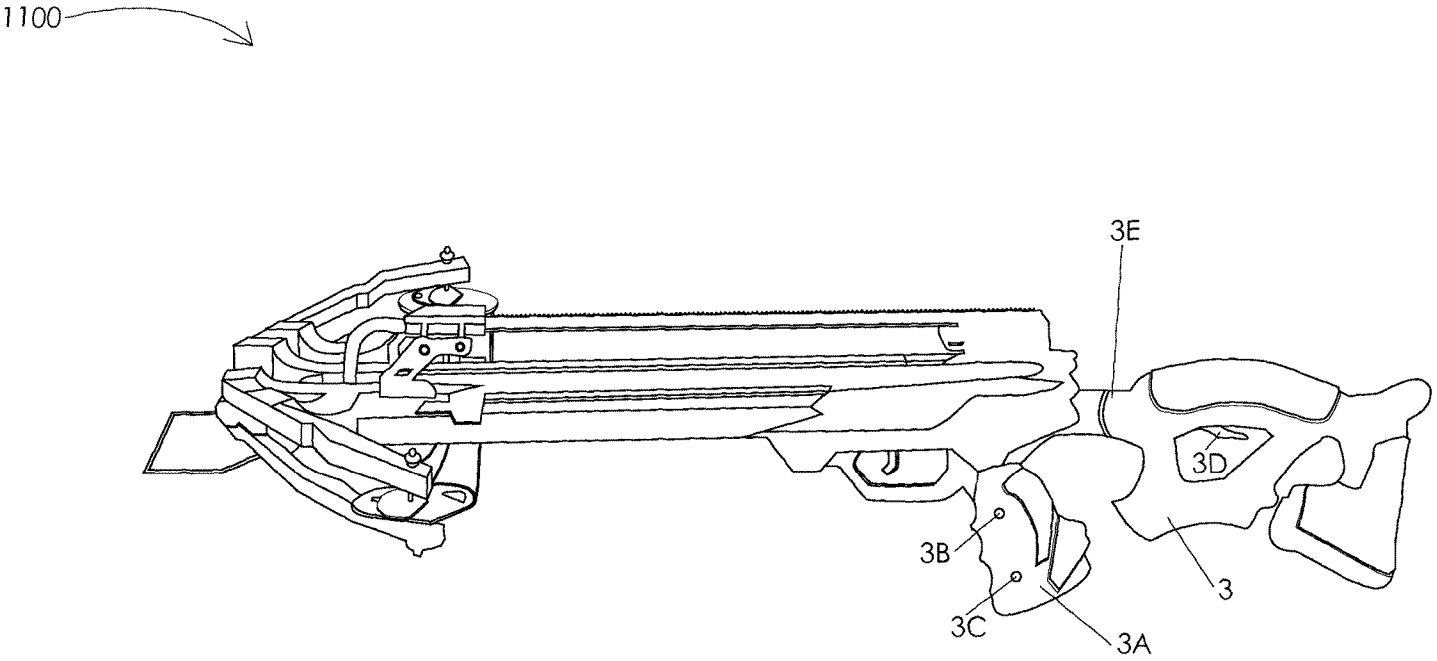
FIG. 11 is a side perspective view of the crossbow and adjustable butt-stock and detachable grip handles according to one embodiment of the present invention.
Figure 12:
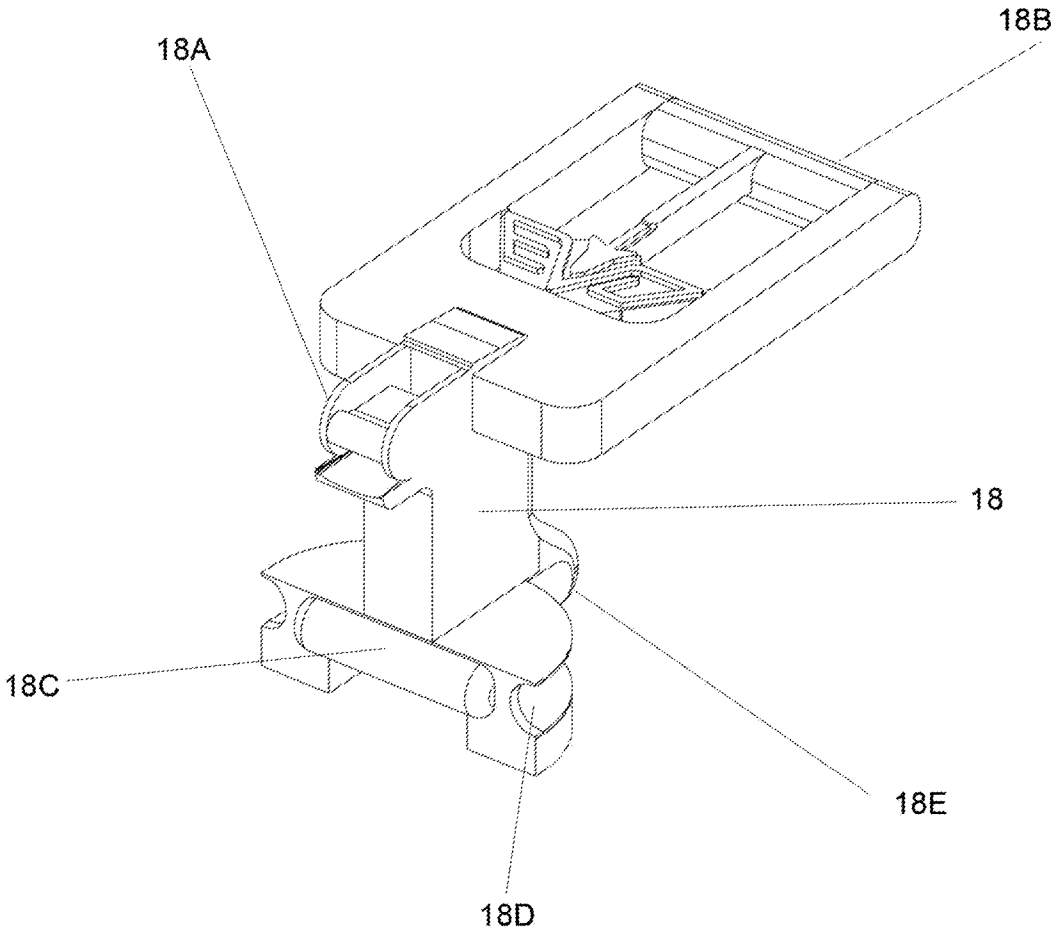
FIG. 12 is the string carriage assembly according to one embodiment of the present invention.
Figure 13:
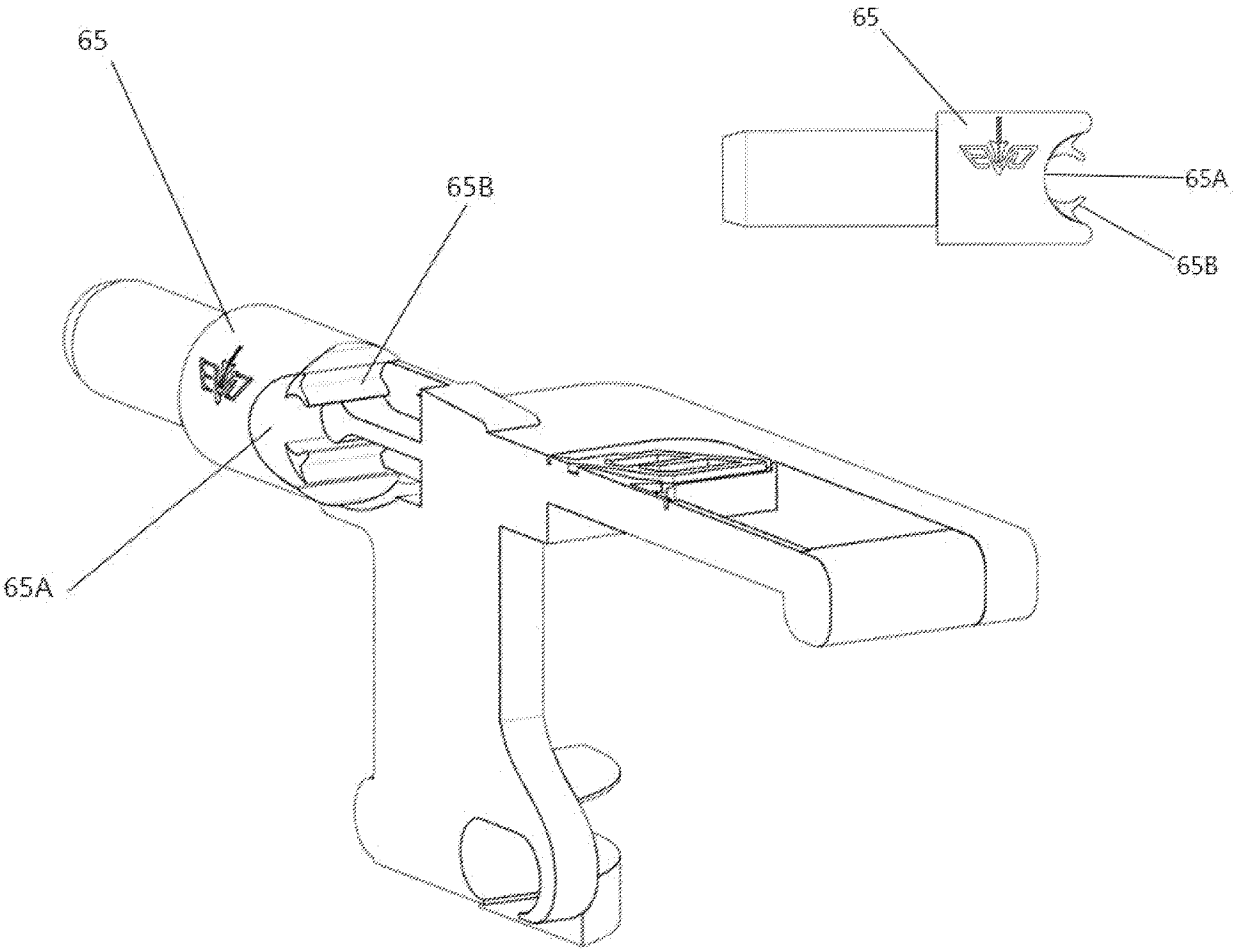
FIG. 13 is a side perspective view of the EVO Hybrid Nock securely fitting into the String Carriage ready to be fired according to one embodiment of the present invention
Figure 14:
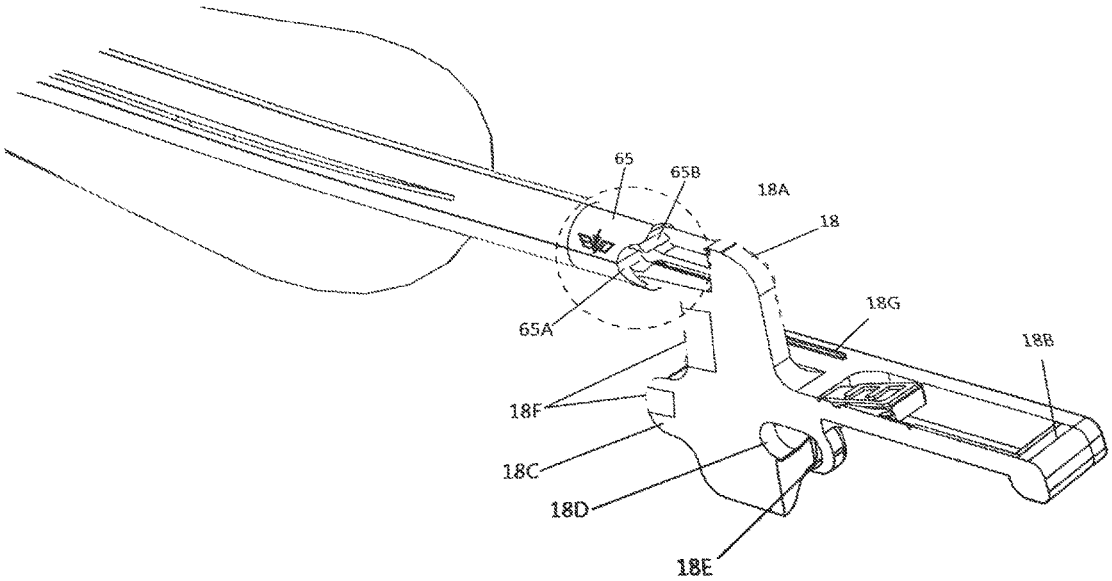
FIG. 14 is a side view of the EVO Hybrid Nock displaying it's unique Full Moon Nock Curve and Full Capture Nock Clip that in one embodiment will securely fit into the String Carriage's Nocking Point as shown in FIG. 13.
Figure 15:
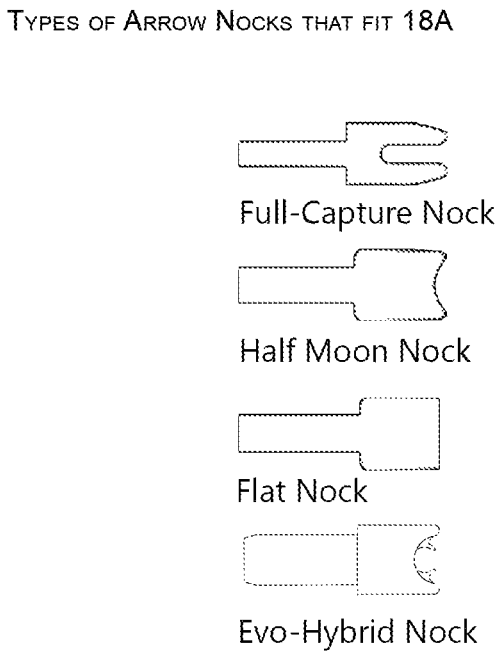
FIG. 15 is a side view of the variety of nocks that fit in the present invention's Carriage's Arrow Nock without alteration to the Carriage.

In one embodiment, a folding fore grip 32 is attached to Picatinny rail using fore grip Picatinny rail mounting system 32A, and is configured to be used either in a standard or a closed position as a fore grip, which is flush and parallel to the body of the crossbow, and further, can be pulled down to a vertical position, or open position, which then can be used as a tactical or vertical grip. In either position, there is removable fore grip thumb guard 32B to protect the fingers of the user from crossing into the path of string 9 when crossbow is in use. In the vertical position, folding fore grip 32 has a ball socket 34 with a spring 34C operatively associated with a push button 34D, pin 34E, and hinge 34F. Ball socket 34 is used such that pin 34E adjusts the height of magnetic ball socket 34A, configured with a rubber ring that assists in preventing slipping when placed on a surface to serve as a model pad for shooting. Ball socket 34, in one embodiment, is also used to connect ball joint adapter 36 via magnets to the shooting stick 38. FIG. 4 shows configuration 400 with shooting stick 38 detached and FIG. 5 shows configuration 500 with shooting stick attached. FIG. 6 is a side partial separated view of the shooting stick grip assembly 600. Shooting stick ball 36 is an attachment apparatus that screws into shooting stick body 38, or any shooting stick mounting base, and snaps into ball socket 34 and firmly stays in place using magnetic ball socket 34A and the shooting stick ball magnet 37 for a secure hold that still provides for rotation within the socket. The shooting stick ball can also be used with shooting stick ears 36B for a balanced and firm shot. In the configuration incorporating magnets, the magnets provide for quick connect/disconnect as needed. In one embodiment, shooting stick 40 is incorporated therewith.

In one embodiment, the present invention reduces the recoil force about 5 to 10% versus a conventional crossbow (as understood herein, the crossbow of the present invention is configured whereby there is no direct contact between the arrow or bolt to be filed and the firing string and the firing string travels on a different geometric plane from the arrow or bolt and a conventional crossbow has either direct contact and/or travels on the same horizontal plane as the arrow/ bolt). The recoil force, as is known in the art, is dependent on the weight of the arrow or bolt being fired and the initial velocity on firing. Conventional crossbows are known to produce approximately 25-50 Joules of force upon firing. Reduction of recoil force is one important feature of the present invention.

In one embodiment, the present invention reduces the sound created upon firing about 5 to 15% versus a conventional crossbow. The sound produced, as is known in the art, is dependent on the weight of the arrow or bolt being fired and the initial velocity on firing and nature of the firing string (including, but not limited to physical characteristics such as string thickness and composition). Conventional crossbows are known to produce approximately 70-80 db of measured at 5 feet. Reduction of firing sound is one important feature of the present invention.

While the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention.

What is claimed is:

1. A crossbow comprised of a barrel, limbs, a string, a carriage and a trigger assembly;

a carriage track is integral to and extends continuously along a bottom length of a vertical slot formed longitudinally through the barrel;

an arrow rest is integral to and extends continuously along a top length of the barrel;

the carriage track is parallel to the arrow rest;

the limbs are affixed to a forward side of the barrel and flex in a plane parallel to the carriage track;

a string is connected to the limbs;

the string moves only along the bottom length of the barrel isolated below the arrow rest by the barrel so that while firing the arrow the string does not contact or rub on the barrel or the carriage track;

the carriage extends vertically though the longitudinal slot in the barrel with an upper end of the carriage extending above the arrow rest and a lower end of the carriage extending below the carriage track;

a central segment of the carriage is guided by and rides along an entire length of the carriage track;

the lower end of the carriage is coupled to the string;

in a cocked configuration, the trigger assembly holds the string and the carriage under tension at an aft end of the carriage track while the upper end of the carriage is above an aft end of the arrow rest coupled to the nock on a rear end of an arrow laying on the arrow rest;

in a firing configuration, the trigger assembly releases the string and the string pushes the lower end of the carriage forward forcing the carriage along the length of the carriage track while the upper end of the carriage in contact with the arrow nock propels the arrow forward.

2. The crossbow as in claim 1 further characterized in that the arrow rest includes a friction reducing feature comprised of any or a combination of a low friction glide strip or a plurality of raised protuberances.

3. The crossbow as in claim 1 further characterized in that the carriage is replaceable with a second carriage that is differently weighted to match a weight of the arrow and a string tension force.

4. The crossbow as in claim 1 further characterized in that upper side of the carriage is configured to clip into the nock to hold the arrow onto the arrow rest while in the cocked configuration.

5. A crossbow comprised of a barrel, a string, a firing mechanism and limbs;

the limbs are connected to a front end of the barrel;

the string is operatively connected to the limbs;

an arrow rest is along an upper longitudinal surface of the barrel;

a first side of a carriage track is along a lower longitudinal surface of the barrel parallel to the arrow rest;

the string has a center-point midway between the limbs;

a second side of the carriage track is below and parallel to the first side of the carriage track;

the center-point of the string travels immediately below the lower longitudinal surface between the first side of the carriage track and the second side of the carriage track between a cocked mode and a firing mode always parallel to the arrow rest so that the string does not ever contact the first side of the carriage track, the second side of the carriage track, the barrel, an arrow or the arrow rest;

a firing mechanism holds the center-point of the string coupled to a carriage at an aft end of the first side of the carriage track when in the cocked mode;

the carriage is movable inside a vertical slot along a longitudinal length of the barrel;

an upper end of the carriage extends above the arrow rest and a lower end of the carriage extends below the first side of the carriage track and into the second side of the carriage track;

a middle segment of the carriage is guided by and rides along the length of the first side of the carriage track;

the center-point of the string is always between the lower side of the carriage and the firing mechanism;

the upper end of the carriage is adapted to connect to a nock of the arrow lying on the arrow rest;

when the firing mechanism is in the cocked mode and releases the carriage, the string presses against the lower end of the carriage and forces the carriage forward so that the carriage moves forward along the first and second sides of the carriage track and the upper end of the carriage moves forward above the arrow rest pressing against the nock to propel the arrow.

6. The crossbow as in claim 5 further characterized in that the arrow rest includes a friction reducing upper surface comprised of any or a combination of a low friction glide strip or a plurality of raised protuberances.

7. The crossbow as in claim 5 further characterized in that the carriage is replaceable with a second carriage that is differently weighted to match a weight of the arrow and a string tension force.

8. The crossbow as in claim 5 further characterized in that upper end of the carriage is configured to clip into the nock to hold the arrow onto the arrow rest while in the cocked mode.

* * * * *